US007917062B2

(12) United States Patent
Shin et al.

(10) Patent No.: US 7,917,062 B2
(45) Date of Patent: Mar. 29, 2011

(54) IMAGE FORMING APPARATUS WITH EASILY OPERABLE INNER AND OUTER COVERS FOR ACCESSING A JAM

(75) Inventors: Koji Shin, Osaka (JP); Yasuhiro Miyake, Osaka (JP)

(73) Assignee: Kyocera Mita Corporation (JP)

( * ) Notice: Subject to any disclaimer, the term of this patent is extended or adjusted under 35 U.S.C. 154(b) by 211 days.

(21) Appl. No.: 12/326,970

(22) Filed: Dec. 3, 2008

(65) Prior Publication Data

US 2009/0142098 A1 Jun. 4, 2009

(30) Foreign Application Priority Data

Dec. 4, 2007 (JP) ..... 2007-313029

(51) Int. Cl.
*G03G 21/00* (2006.01)

(52) U.S. Cl. ..... 399/124

(58) Field of Classification Search ..... 399/107, 399/124, 401

See application file for complete search history.

(56) References Cited

U.S. PATENT DOCUMENTS

| | | | | |
|---|---|---|---|---|
| 5,802,426 | A * | 9/1998 | Miyazaki et al. | 399/113 |
| 5,839,032 | A * | 11/1998 | Yasui et al. | 399/124 |
| 5,887,228 | A * | 3/1999 | Motohashi et al. | 399/111 |
| 7,031,639 | B2 * | 4/2006 | Masuda et al. | 399/124 |
| 7,203,448 | B2 * | 4/2007 | Yokoi | 399/124 |
| 7,317,887 | B2 * | 1/2008 | Otaka | 399/124 |
| 7,460,814 | B2 * | 12/2008 | Ito | 399/124 |
| 7,526,214 | B2 * | 4/2009 | Asaba | 399/21 |
| 7,536,133 | B2 * | 5/2009 | Kang | 399/124 |
| 7,653,326 | B2 * | 1/2010 | Ozawa | 399/110 |

FOREIGN PATENT DOCUMENTS

| | | |
|---|---|---|
| JP | 2004-123393 | 4/2004 |
| JP | 2005-55862 | 3/2005 |
| JP | 2005-138967 | 6/2005 |

* cited by examiner

*Primary Examiner* — Robert Beatty
(74) *Attorney, Agent, or Firm* — Gerald E. Hespos; Michael J. Porco

(57) ABSTRACT

An image forming apparatus is provided with an apparatus main body, a cover member openably and closably mounted on the apparatus main body, and an engaging portion. The cover member includes an outer cover and an inner cover which are independently opened and closed, and the inner cover is positioned by being pushed by the outer cover when the cover member is closed. The engaging portion is provided in the apparatus main body for temporarily holding the inner cover in the apparatus main body.

17 Claims, 14 Drawing Sheets

IMAGE FORMING APPARATUS WITH EASILY OPERABLE INNER AND OUTER COVERS FOR ACCESSING A JAM

BACKGROUND OF THE INVENTION

1. Field of the Invention

The present invention relates to an image forming apparatus provided with an opening cover, particularly with a vertical conveyance cover which is opened and closed at the time of a jam processing.

2. Description of the Related Art

In an image forming apparatus such a printer or a copier for forming an image on a sheet by an electrophotographic method, an electrostatic latent image formed on an image bearing member such as a photoconductive drum is developed into a toner image and this toner image is transferred to a sheet fed at a suitable timing by a pair of registration rollers. The sheet having the toner image transferred thereto is conveyed to a fixing unit and is discharged onto a discharge tray outside the apparatus after having the toner image fixed by heat and pressure in the fixing unit. In this way, a series of image forming operations are completed.

There is known an image forming apparatus provided with a vertical conveyance cover which is openable and closable and constitutes a part of a sheet conveyance path so that a jammed sheet can be easily removed in the case of a jam in the sheet conveyance path during an image forming operation.

A known image forming apparatus of this type is such that a vertical conveyance cover is made up of an outer cover and an inner cover, which are independently opened and closed, and the position of the inner cover is determined by being pushed by the outer cover during a closing operation (see, for example, Japanese Unexamined Patent Publications Nos. 2005-138967 and 2004-123393).

In such an image forming apparatus, the outer and inner covers of the vertical conveyance cover are locked onto an apparatus main body by means of hooks respectively provided on these outer and inner covers. In this case, there is also proposed an image forming apparatus provided with a link mechanism for operating a link of an inner cover as a hook of an outer cover is operated (see, for example, Japanese Unexamined Patent Publications No. 2005-055862).

However, if the outer and inner covers of the vertical conveyance cover are locked onto the apparatus main body by means of the hooks respectively provided on these outer and inner covers, the number of parts increases. Further, since the opening/closing operability of the outer and inner covers is deteriorated, there has been a problem of reducing the operability of a jam processing.

SUMMARY OF THE INVENTION

An object of the present invention is to promote a cost reduction by reducing the number of parts and to improve the opening/closing operability of a cover member.

In order to accomplish this object, one aspect of the present invention is directed to an image forming apparatus, comprising an apparatus main body; a cover member openably and closably mounted on the apparatus main body and including an outer cover and an inner cover which are independently opened and closed, the inner cover being positioned by being pushed by the outer cover when the cover member is closed; and an engaging portion provided in the apparatus main body for temporarily holding the inner cover in the apparatus main body.

DETAILED DESCRIPTION OF THE PREFERRED EMBODIMENTS

Figure 1:
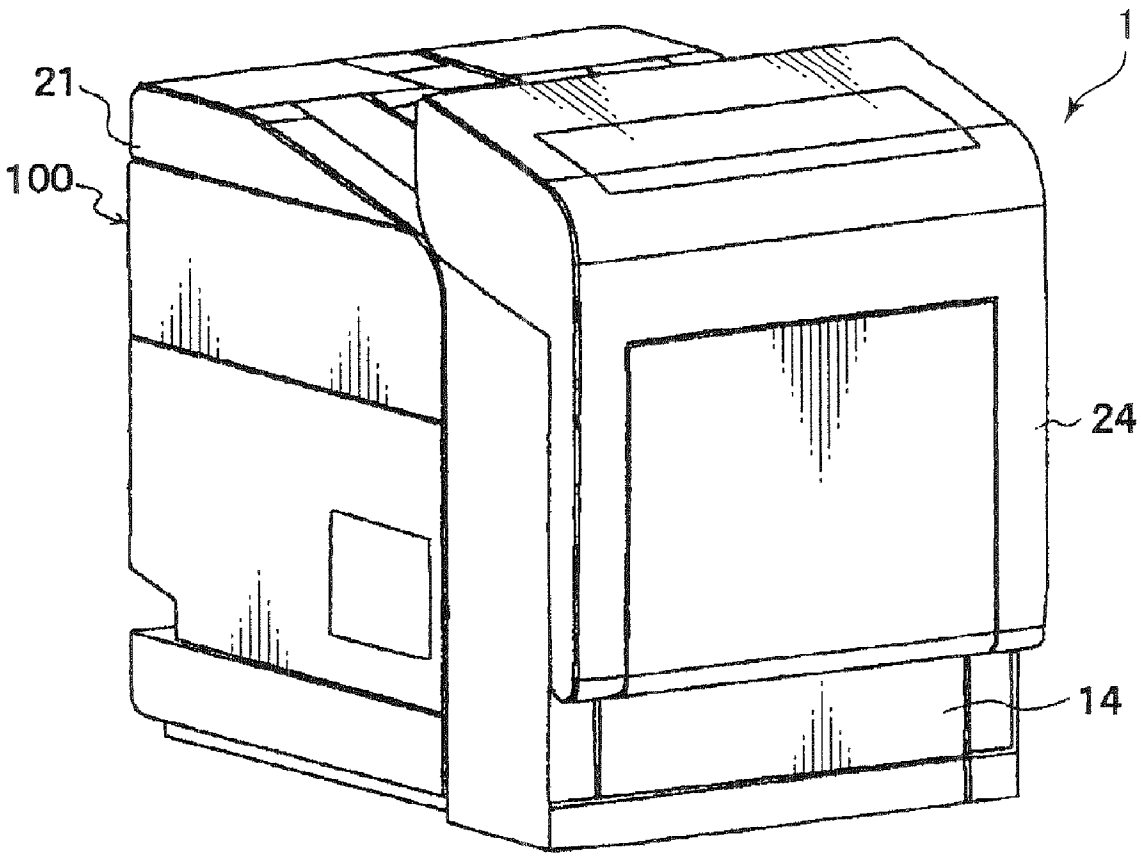
FIG. 1 is a perspective view of a color laser printer according to one embodiment of the invention.
Figure 2:
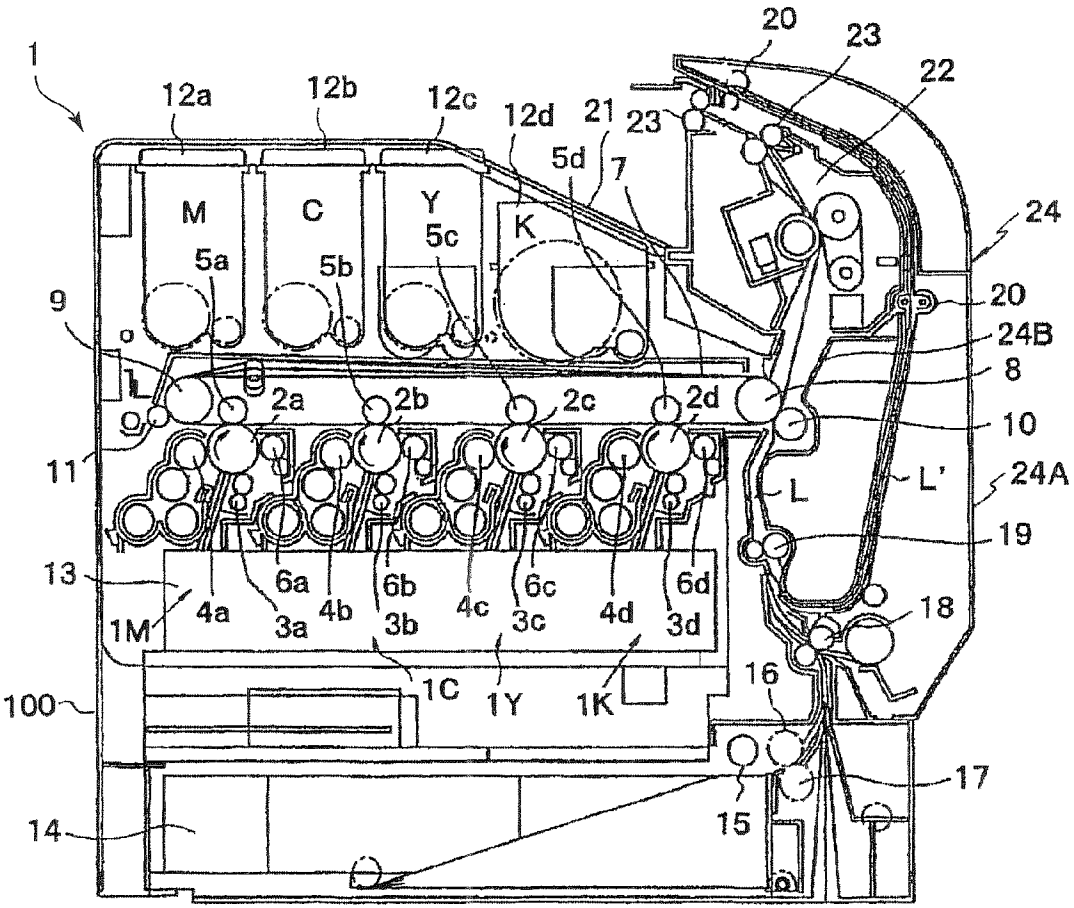
FIG. 2 is a section showing the internal construction of the color laser printer.

One embodiment of the present invention is described below with reference to the accompanying drawings. FIG. 1 is perspective view of a color laser printer 1 as one embodiment of an image forming apparatus of the present invention, and FIG. 2 is a section showing the internal construction of the color laser printer 1. The color laser printer 1 is provided with an apparatus main body 100 in the form of a rectangular box. A vertical conveyance cover 24 (cover member), which doubles as a front cover and is opened and closed at the time of a jam processing, is provided on the front surface of the apparatus main body 100. A discharge tray 21 is openably and closably provided at the top of the apparatus main body 100.

Four image forming units, i.e. a magenta image forming unit 1M, a cyan image forming unit 1C, a yellow image forming unit 1Y and a black image forming unit 1K are arranged at specified intervals in a tandem manner in a central part of the interior of the main body 100 of the color laser printer 1. In addition, a laser scanner unit (LSU) 13, a sheet cassette 14, a fixing unit 22, a conveyance path (first conveyance path) L and a reversing conveyance path L' (second conveyance path) are provided in the main body 100.

The respective image forming units 1M, 1C, 1Y and 1K include photoconductive drums 2*a*, 2*b*, 2*c* and 2*d*, and charging rollers 3*a*, 3*b*, 3*c* and 3*d*, developing devices 4*a*, 4*b*, 4*c* and 4*d*, primary transfer rollers 5*a*, 5*b*, 5*c* and 5*d* and drum cleaning devices 6*a*, 6*b*, 6*c* and 6*d* are respectively arranged around the corresponding photoconductive drums 2*a* to 2*d*.

Each of the photoconductive drums 2*a* to 2*d* is a drum-shaped photoconductor and is driven to rotate at a specified process speed in a direction of an arrow in FIG. 2 (clockwise direction) by an unillustrated variable speed stepping motor. The charging rollers 3*a* to 3*d* uniformly charge the outer surfaces of the corresponding photoconductive drums 2*a* to 2*d* to a specified potential by charging biases applied from an unillustrated charging bias power supply.

The developing devices 4*a* to 4*d* respectively contain magenta (M) toner, cyan (C) toner, yellow (Y) toner and black (K) toner and develop electrostatic latent images formed on the respective photoconductive drums 2*a* to 2*d* into toner images of the respective colors by attaching the toners of the respective colors to the electrostatic latent images.

The primary transfer rollers 5*a* to 5*d* are so arranged as to be able to come into contact with the corresponding photoconductive drums 2*a* to 2*d* via an intermediate transfer belt 7 at corresponding primary transfer positions. Here, the intermediate transfer belt 7 is mounted between a secondary transfer facing roller 8 and a tension roller 9 and arranged to be movable in a circulating manner above the respective photoconductive drums 2*a* to 2*d*. The secondary transfer facing roller 8 is so arranged as to be able to come into contact with a secondary transfer roller 10 (roller member) via the intermediate transfer belt 7 at a secondary transfer position (image transfer portion). Further, a belt cleaning device 11 is disposed near the tension roller 9.

Toner containers 12*a*, 12*b*, 12*c* and 12*d* for resupplying magenta, cyan, yellow and black toners to the respective developing devices 4*a* to 4*d* are arranged in a line above the respective image forming units 1M, 1C, 1Y and 1K in the apparatus main body 100.

The LSU 13 is arranged below the respective image forming units 1M, 1C, 1Y and 1K and exposes the respective photoconductive drums 2*a* to 2*d* with laser lights based on image information transmitted from a personal computer (not shown) or the like, thereby removing electric charges in exposed parts to form electrostatic latent images.

The sheet cassette 14 is arranged below the LSU 13 at the bottom of the apparatus main body 100 and is detachably mountable into the apparatus main body 100. A stack of a plurality of unillustrated sheets is stored in the sheet cassette 14. A pickup roller 15 for dispensing the sheets one by one from the sheet cassette 14 and a feed roller 16 and a retard roller 17 for feeding the dispensed sheet to the conveyance path L are disposed near this sheet cassette 14.

The fixing unit 22 includes a fixing roller and a pressure roller and fixes a toner image to a sheet by heating and pressing the sheet having the toner image transferred thereto.

The conveyance path L is a conveyance path vertically extending at a lateral part of the apparatus main body 100 and includes a pair of conveyor rollers 18 for conveying a sheet and a pair of registration rollers 19 for feeding the sheet to the secondary transfer portion as a nip portion between the secondary transfer facing roller 8 and the secondary transfer roller 10 at a specified timing after causing the sheet to temporarily wait on standby. The conveyance path L extends up to the discharge tray 21 provided on the upper surface of the apparatus main body 100, and the fixing unit 22 and a pair of discharge rollers 23 are arranged at intermediate positions thereof.

The reversing conveyance path L' is a conveyance path arranged at an outer side of the conveyance path L and vertically extending. The reversing conveyance path L' is used in the case of forming images on both sides of a sheet and adapted to return the sheet having passed the secondary transfer portion to a side of the conveyance path L upstream of the secondary transfer portion. A plurality of pairs of conveyor rollers 20 are arranged at appropriate intervals on this conveyance path L'.

Next, the image forming operation by the color laser printer 1 having the above construction is described with reference to FIG. 2. When an image formation start signal is given to the printer 1, the respective photoconductive drums 2*a* to 2*d* are driven to rotate at the specified process speed in the arrow direction of FIG. 2 (clockwise direction) in the respective image forming units 1M, 1C, 1Y and 1K, and these photoconductive drums 2*a* to 2*d* are uniformly charged by the charging rollers 3*a* to 3*d*. The LSU 13 emits laser lights modulated by color image signals of the respective colors to irradiate the outer surfaces of the respective photoconductive drums 2*a* to 2*d* with these laser lights, whereby electrostatic latent images corresponding to the color image signals of the respective colors are respectively formed on the photoconductive drums 2*a* to 2*d*.

First of all, the magenta toner is attached to the electrostatic latent image formed on the photoconductive drum 2*a* of the magenta image forming unit 1M by the developing device 4*a* applied with a development bias of the same polarity as the charging polarity of the photoconductive drum 2*a*. In this way, the electrostatic latent image on the photoconductive drum 2*a* is developed into a visible magenta toner image. This magenta toner image is primarily transferred onto the intermediate transfer belt 7 driven to rotate in an arrow direction of FIG. 2 by the action of the transfer roller 5*a* applied with a primary transfer bias having a polarity opposite to that of the toner in a primary transfer portion (transfer nip portion) between the photoconductive drum 2*a* and the transfer roller 5*a*.

The intermediate transfer belt 7 having the magenta toner image primarily transferred thereto as described above is moved to the next cyan image forming unit 1C. In the cyan image forming unit 1C as well, a cyan toner image formed on the photoconductive drum 2*b* is transferred and superimposed onto the magenta toner image on the intermediate transfer belt 7 in a primary transfer portion similar to the above.

Similarly, yellow and black toner images respectively formed on the photoconductive drums 2*c*, 2*d* of the yellow and black image forming units 1Y, 1K are successively transferred and superimposed onto the magenta and cyan toner images transferred to the intermediate transfer belt 7. In this way, a full color toner image is formed on the intermediate transfer belt 7. Transfer residual toners residual on the respective photoconductive drums 2*a* to 2*d* without being transferred to the intermediate transfer belt 7 are removed by the corresponding drum cleaning devices 6*a* to 6*d*, and the respective photoconductive drums 2*a* to 2*d* are prepared for the next image formations.

In synchronism with an arrival timing of the leading end of the full color toner image on the intermediate transfer belt 7 to the secondary transfer portion (transfer nip portion) between the secondary transfer facing roller 8 and the secondary transfer roller 10, the sheet is fed to the secondary transfer portion by the pair of registration rollers 19. In order to realize such a sheet feed, the sheet is fed from the sheet cassette 14 to the conveyance path L by the pickup roller 15, the feed roller 16 and the retard roller 17 and is temporarily stopped by the pair of registration rollers 19. Thereafter, the full color toner image is secondarily transferred at once from the intermediate transfer belt 7 to the sheet conveyed to the secondary transfer portion by the secondary transfer roller 10 applied with a secondary transfer bias having a polarity opposite to that of the toner.

Thereafter, the sheet having the full color toner image transferred thereto is conveyed to the fixing unit 22 along the conveyance path L and the full color toner image is thermally fixed to the surface of the sheet by being heated and pressed. The sheet having the toner image fixed thereto is discharged onto the discharge tray 21 by the pair of discharge rollers 23, whereby a series of image forming operations are completed. Transfer residual toner residual on the intermediate transfer belt 7 without being transferred to the sheet is removed by the belt cleaning device 11 and the intermediate transfer belt 7 is prepared for the next image formation. The above is a series of operations in the case of forming an image on one side of a sheet.

In the case of forming images on both sides of a sheet, the sheet having a toner image fixed to one side thereof by the fixing unit 22 is fed to the reversing conveyance path L' by an unillustrated switching flapper. The sheet is conveyed along the conveyance path L' by the plurality of pairs of conveyor rollers 20 arranged on the conveyance path L', transferred from the conveyance path L' to the conveyance path L after being turned upside down and fed to the pair of registration rollers 19 again. Thereafter, a toner image on the intermediate transfer belt 7 is transferred to the other side of the sheet by operations similar to the above and is fixed by the fixing unit 22, whereby the images are formed on the both sides of the sheet. The sheet having the images formed on the both sides is discharged onto the discharge tray 21 by the pair of discharge rollers 23 similar to the above.

Figure 3:
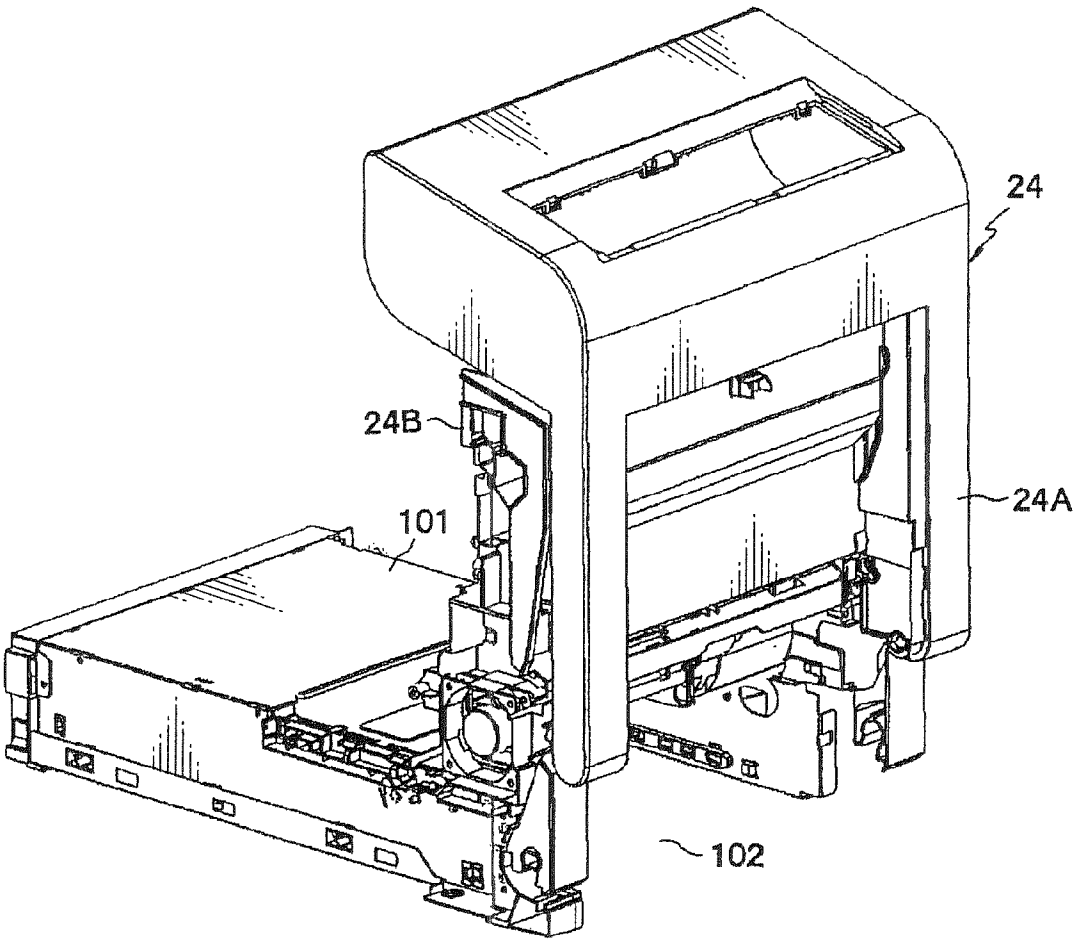
FIG. 3 is a perspective view showing a vertical conveyance cover and its periphery of the color laser printer.
Figure 5:
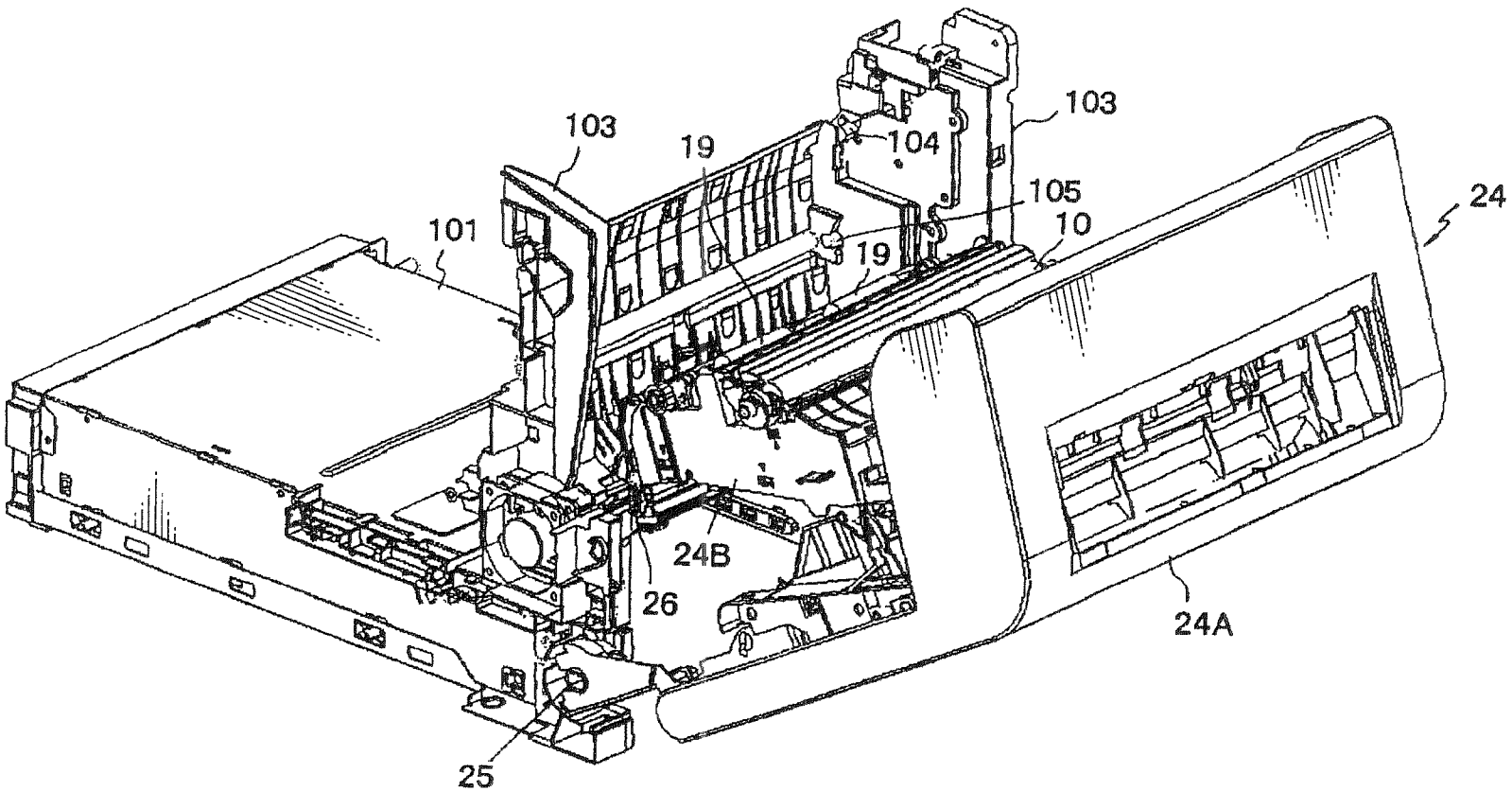
FIG. 5 is a perspective view showing a state where an inner cover of the vertical conveyance cover is opened.
Figure 6:
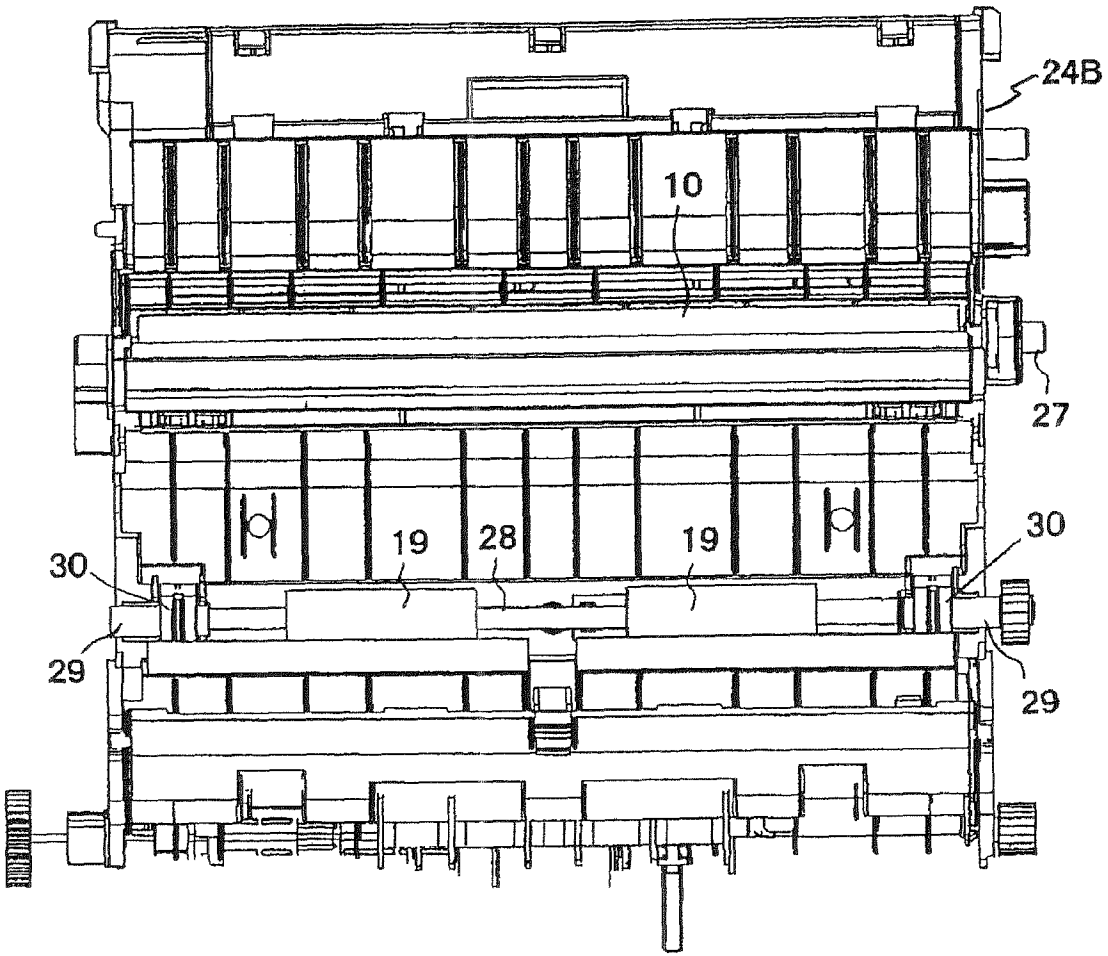
FIG. 6 is a front view of the inner surface of the inner cover.
Figure 7:
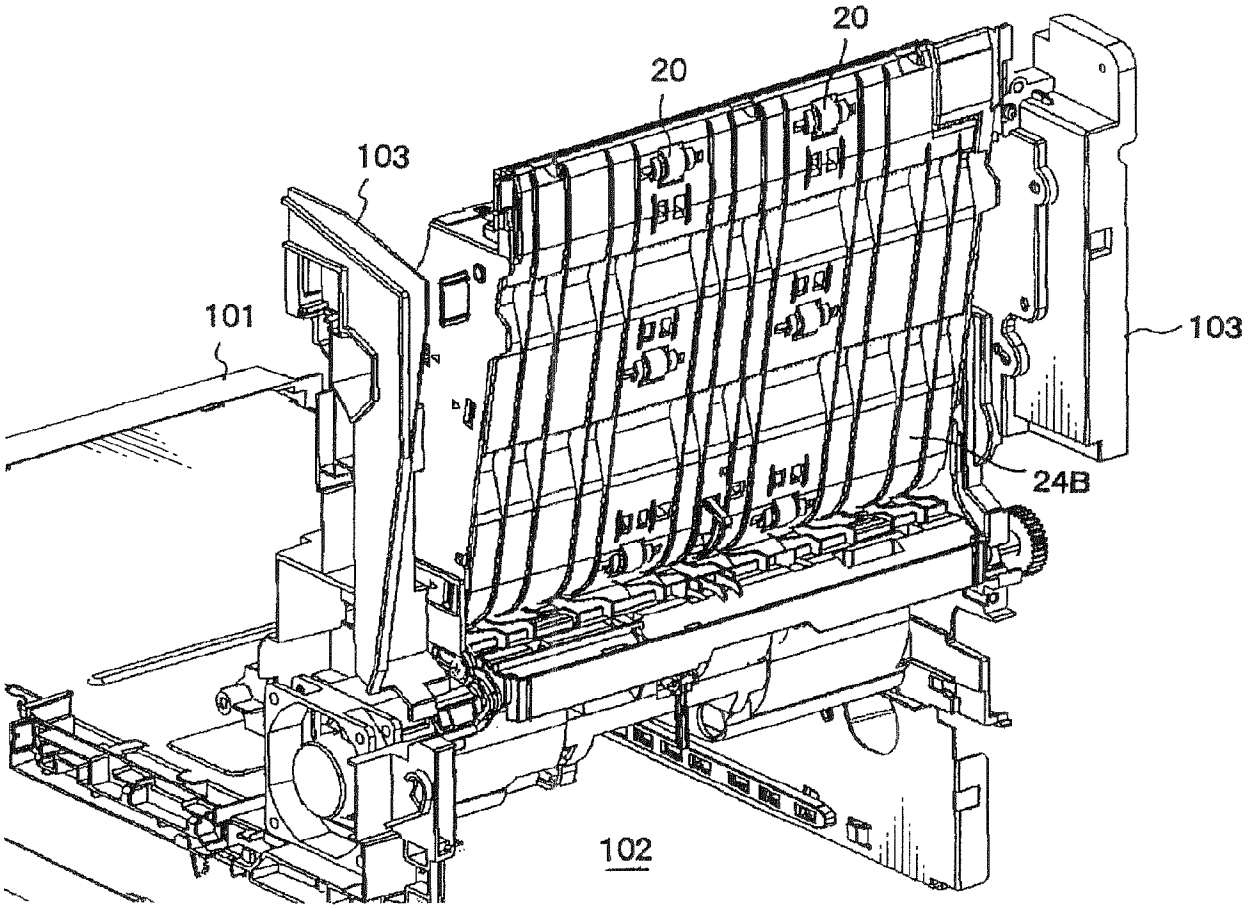
FIG. 7 is a perspective view showing a state where the inner cover is temporarily held.
Figure 8:
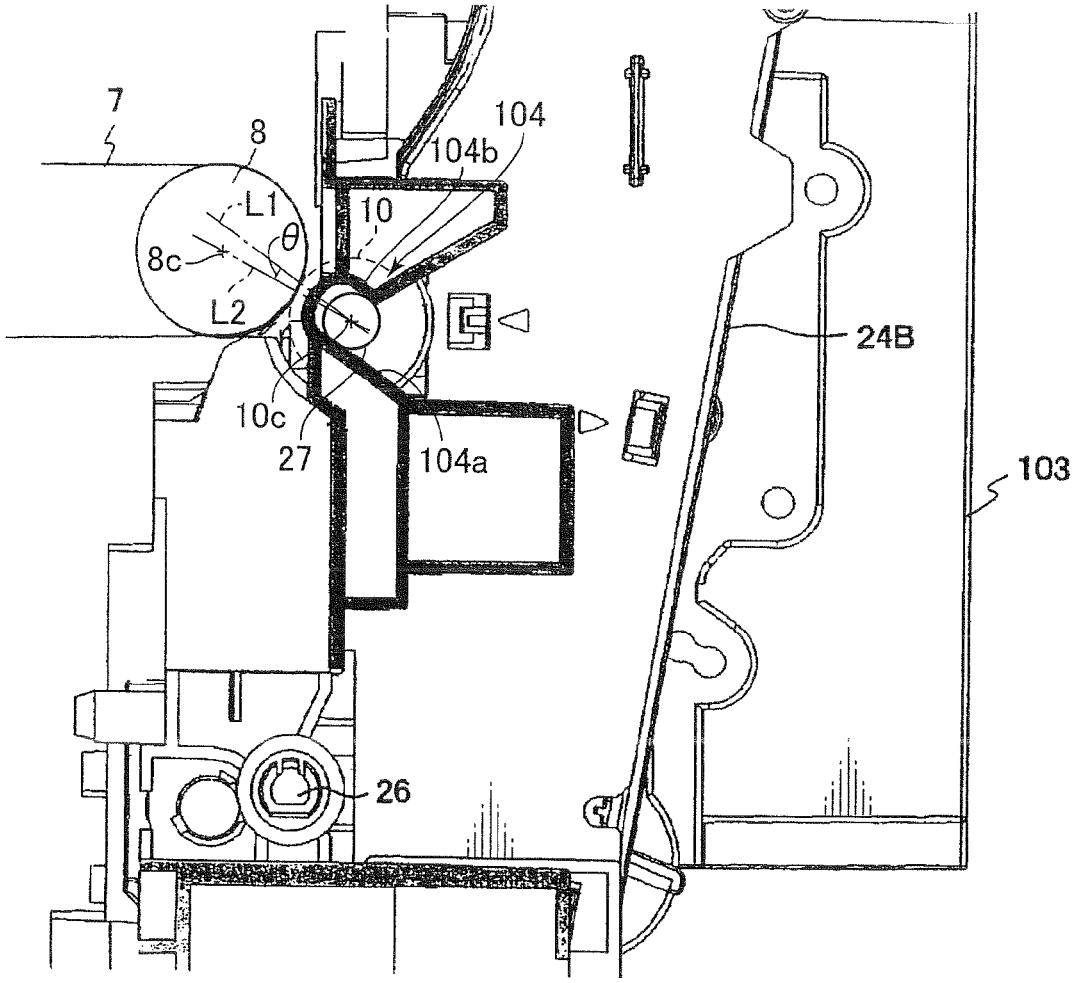
FIG. 8 is a side view partly in section showing an engaging portion in the state where the inner cover is temporarily held.
Figure 9:
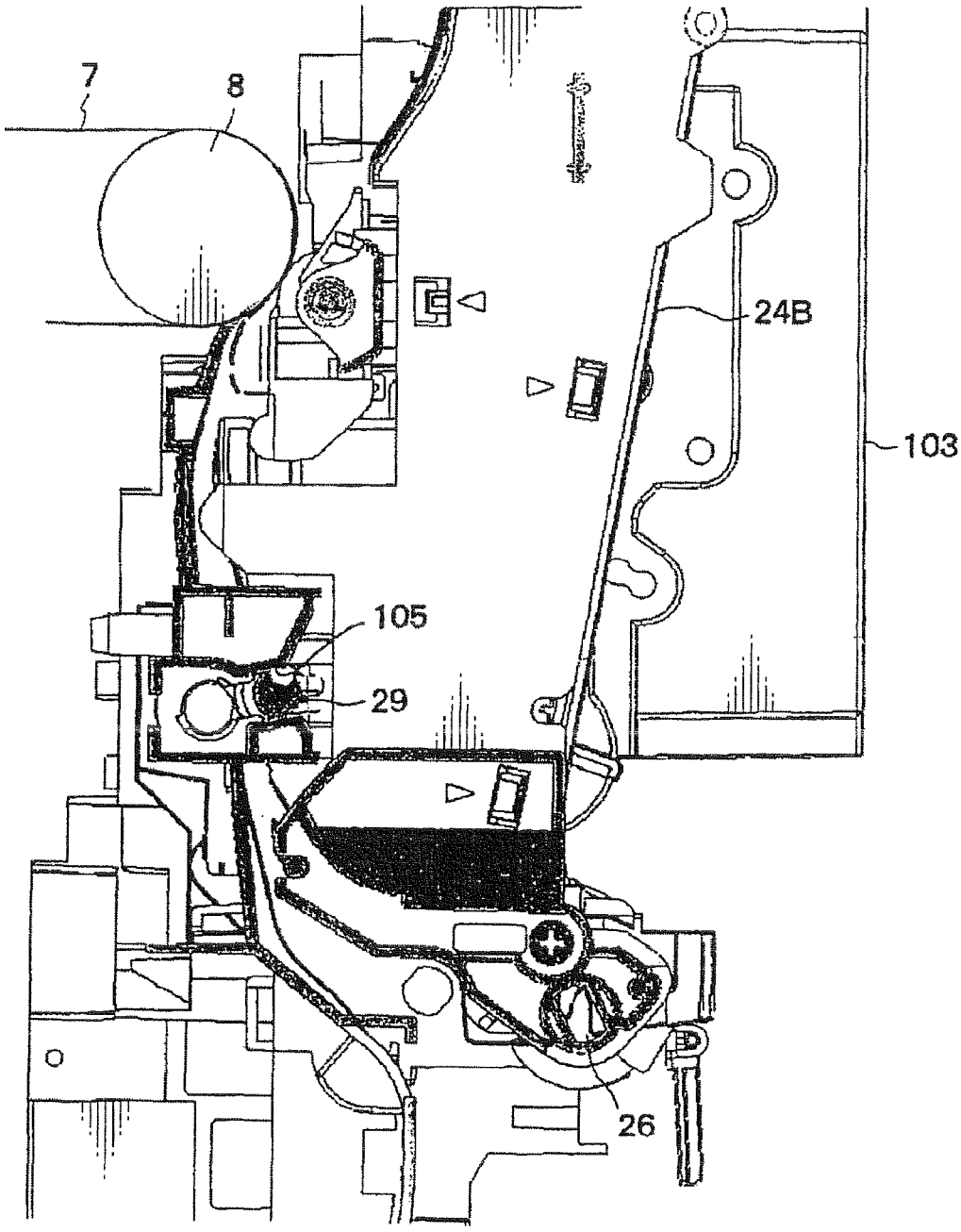
FIG. 9 is a side view partly in section showing a guiding portion in the state where the inner cover is temporarily held.
Figure 10:
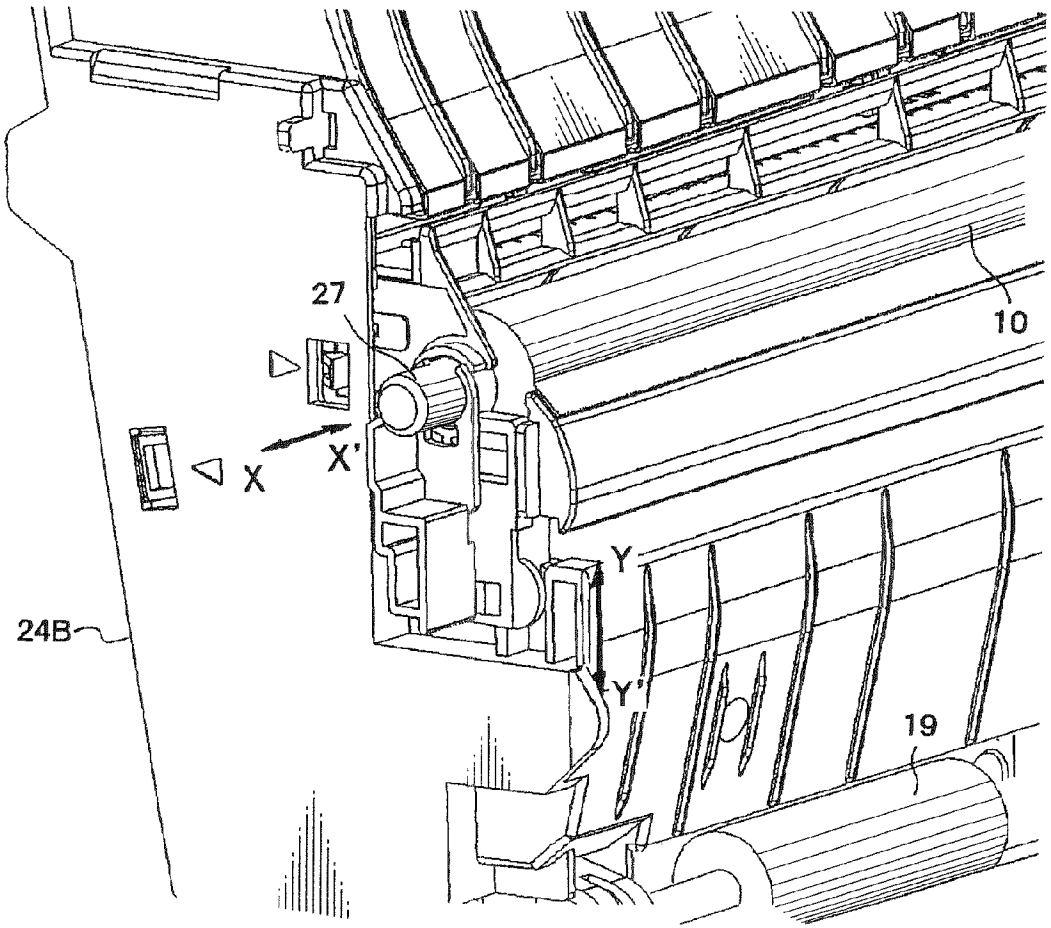
FIG. 10 is a perspective view showing a secondary transfer roller and its periphery of the color laser printer.

Next, the vertical conveyance cover 24 and its periphery of the color laser printer 1 are described with reference to FIGS. 3 to 10. FIG. 3 is a perspective view showing the vertical conveyance cover 24, FIG. 4 is a side view showing a state where the vertical conveyance cover 24 is opened, FIG. 5 is a perspective view showing a state where an inner cover 24B of the vertical conveyance cover 24 is opened, FIG. 6 is a front view of the inner surface of the inner cover 24B, FIG. 7 is a perspective view showing a state where the inner cover 24B is temporarily held, FIG. 8 is a side view partly in section showing an engaging portion in the state where the inner cover 24B is temporarily held, FIG. 9 is a side view partly in section showing a guiding portion in the state where the inner cover 24B is temporarily held, and FIG. 10 is a perspective view showing the secondary transfer roller 10 and its periphery.

Figure 4:
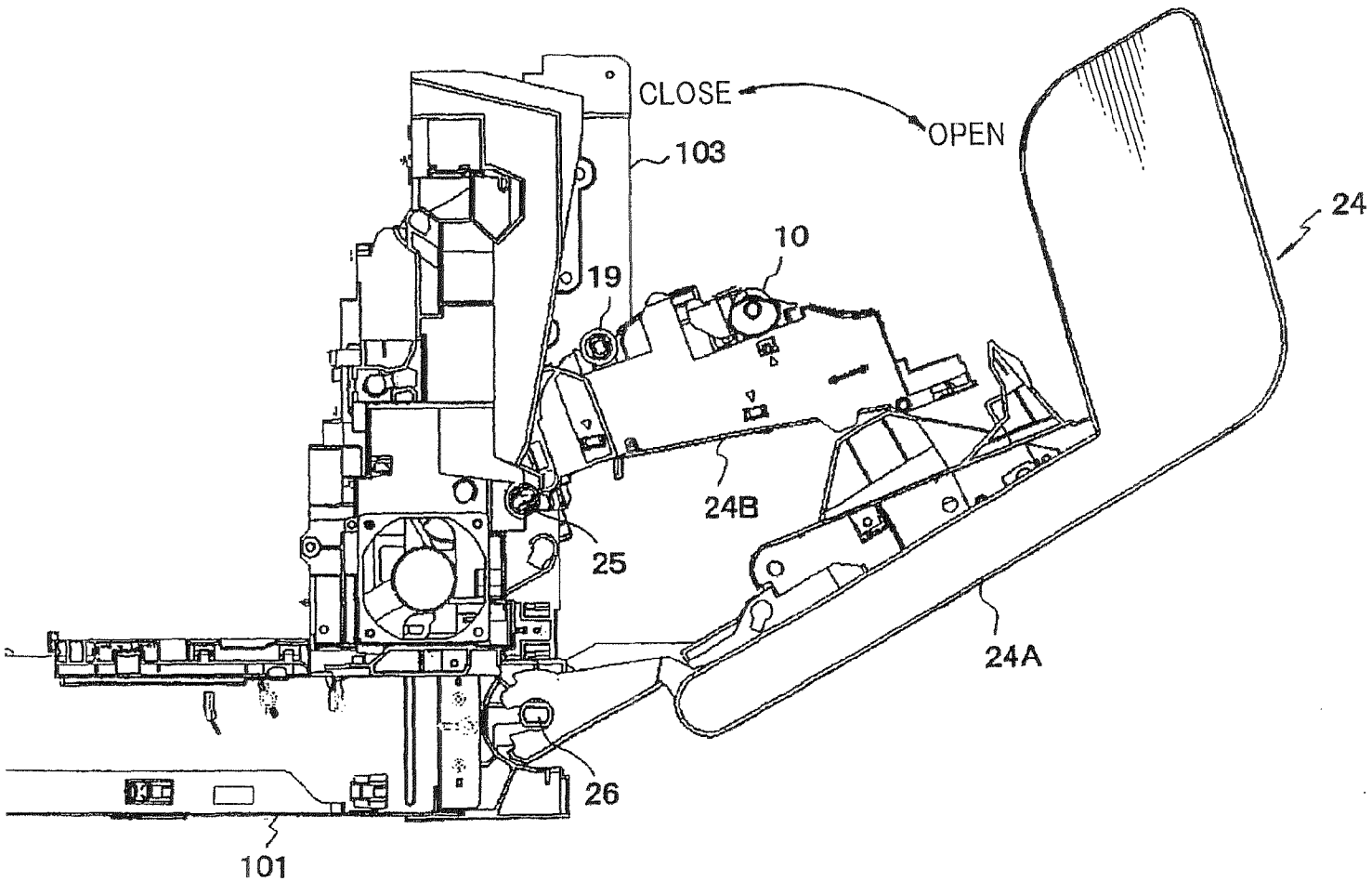
FIG. 4 is a side view showing a state where the vertical conveyance cover is opened.

As shown in FIGS. 3 and 4, the vertical conveyance cover 24 (cover member) includes an outer cover 24A and the inner cover 24B arranged at an inner side of the outer cover 24A. The outer cover 24A is so supported as to be rotatable about a first supporting shaft 26 (first shaft member) and the inner cover 24B is so supported as to be rotatable about a second supporting shaft 25 (second shaft member), so that the outer and inner covers 24A, 24B can be independently opened and closed. The first supporting shaft 26 is arranged at a lower position of one side surface of the apparatus main body 100, and the second supporting shaft 25 is arranged at a position above the first supporting shaft 26.

The outer and inner covers 24A, 24B pivot in conjunction with each other. When the conveyance cover 24 is opened, the inner cover 24B is opened by being pulled by the outer cover 24A. When the conveyance cover 24 is closed, the position of the inner cover 24B is positioned by being pushed by the outer cover 24A. The associated operations of these outer and inner covers 24A, 24B are described in more detail later with reference to FIGS. 11 to 14.

Here, a wall surface of the conveyance path L at one side (see FIG. 2) is formed by the inner surface of the inner cover 24B. Further, a wall surface of the reversing conveyance path L' at one side is formed by the outer surface of the inner cover 24B and that of the reversing conveyance path L' at the other side is formed by the inner surface of the outer cover 24A. As shown in FIG. 3, a cassette mounting portion 102 formed by a body frame 101 made of sheet metal makes an opening below the vertical conveyance cover 24. The above sheet cassette 14 is mounted into and detached from the cassette mounting portion 102.

One of each pair of conveyor rollers 20 (see FIG. 2) arranged along the reversing conveyance path L' is rotatably mounted on the inner surface of the outer cover 24A. The other roller of each pair of conveyor rollers 20 is rotatably mounted on the outer surface of the inner cover 24B (see FIG. 7).

As shown in FIGS. 4 to 6, the secondary transfer roller 10 and one of the pair of registration rollers 19 are rotatably held on the inner surface of the inner cover 24B. Here, as shown in FIG. 5, engaging portions 104 (only one is shown in FIG. 5) for being engaged with the first bearings 27 (shaft receiving members) for supporting a rotary shaft of the secondary transfer roller 10 and guiding portions 105 (only one is shown in FIG. 5) for guiding second bearings 29 for supporting a rotary shaft 28 of the registration roller 19 are formed in the inner surfaces of left and right plates 103 of the body frame 101.

As shown in detail in FIG. 8, each engaging portion 104 is in the form of a groove obliquely extending upward to the back (to the left in FIG. 8) of the apparatus main body 100. The engaging portion 104 is formed with a guiding surface 104*a* in the form of a slant for guiding the first bearing 27 of the secondary transfer roller 10 to the engaging portion 104, and a receiving surface 104*b* onto which the first bearing 27 is fitted. Here, a straight line L1 corresponding to the inclination of an extending direction of the receiving surface 104*b* is inclined at a specified angle θ to a line L2 connecting a shaft center 10*c* of the secondary transfer roller 10 and a shaft center 8*c* of the secondary transfer facing roller 8.

As shown in detail in FIG. 9, each guiding portion 105 is in the form of a guide groove inclined slightly downward to the back (to the left in FIG. 9) of the apparatus main body 100.

The secondary transfer roller 10 is supported movably along longitudinal directions (directions of arrows X-X' of FIG. 10) and vertical directions (directions of arrows Y-Y' of FIG. 10) by unillustrated springs. Further, as shown in FIG. 6, the rotary shaft 28 of the registration roller 19 is rotatably supported by sleeve-shaped bearings 29 at the opposite longitudinal ends of the rotary shaft 28 and the bearings 29 are held on the inner cover 24B by retaining members 30 made of resin. A pair of left and right bearings 29 and the registration roller 19 supported thereby are held by being pressed against the retaining members 30 by unillustrated pressing springs.

In the printer 1, the image forming operation is performed with the vertical conveyance cover 24 comprised of the outer and inner covers 24A, 24B closed as shown in FIGS. 1 to 3. At this time, the first bearings 27 of the secondary transfer roller 10 held on the inner cover 24B are engaged with the engaging portions 104 of the apparatus main body 100 as shown in FIG. 8, whereby the closed state of the inner cover 24B is temporarily held (see FIG. 7). Further, the bearings 29 of the registration roller 19 are fitted into the guiding portions 105 of the apparatus main body 100 to position the registration roller 19.

Specifically, when the first bearings 27 of the secondary transfer roller 10 are engaged with the engaging portions 104 along the guiding surfaces 104*a*, the secondary transfer roller 10 is pressed against the secondary transfer facing roller 8 with the intermediate transfer belt 7 held therebetween. Then, the secondary transfer roller 10 receives a reaction force from the secondary transfer facing roller 8.

Here, the receiving surfaces 104*b* extend along the straight line L1 inclined at the specified angle θ to the line L2 connecting the shaft center 10*c* of the secondary transfer roller 10 and the shaft center 8*c* of the secondary transfer facing roller 8. Thus, the first bearings 27 are received by the receiving surfaces 104*b* of the engaging portions 104 to exhibit a fixing effect, whereby the inner cover 24B is temporarily held by the engaging portions 104. In this way, a force of the secondary transfer facing roller 8 for pressing the secondary transfer roller 10 is utilized as a force for temporarily holding the inner cover 24B. Here, the angle of inclination θ of the receiving surfaces 104*b* sets the reaction force received by the secondary transfer roller 10 from the secondary transfer facing roller 8 at a value sufficient to receive the rotary shaft 27.

In the case of a jam of a sheet in the conveyance path L or the reversing conveyance path L' during the image forming operation, a user operates an unillustrated lever to unlock the outer cover 24A of the vertical conveyance cover 24. Then, the outer cover 24A is rotated forward about the first supporting shaft 26 to be opened. Then, the inner cover 24B is simultaneously opened as shown in FIG. 4 as the outer cover 24A is opened. Thus, the user can simultaneously confirm states of the conveyance paths L, L'.

In the case of a sheet jam in the conveyance path L, the user can directly remove the jammed sheet from the conveyance path L. Further, in the case of a sheet jam in the reversing conveyance path L', the user closes the inner cover 24B and temporarily holds it in the engaging portions 104. By this temporary holding, the bearings 29 of the registration roller 19 are also fitted into the guiding portions 105 of the apparatus main body 100 to position the registration roller 19. In this state, the user can remove the jammed sheet in the reversing conveyance path L'.

When a jam processing of removing the jammed sheet in the conveyance path L is completed and the user rotates the outer cover 24A in a counterclockwise direction in FIG. 4 about the first supporting shaft 26 and closes it, the inner cover 24B is pushed by the outer cover 24A to rotate in the counterclockwise direction in FIG. 4 about the second supporting shaft 25. The inner cover 24B is first temporarily held on the apparatus main body 100 as described above and, then, the outer cover 24A is fixed by an unillustrated hook to be locked in the closed state.

Also when a jam processing of removing the jammed sheet in the reversing conveyance path L' is completed, the user rotates only the outer cover 24A in the counterclockwise direction in FIG. 4 about the first supporting shaft 26 to close it. In this case, since the inner cover 24B is already temporarily held in the engaging portions 104, only the outer cover 24A is fixed by the unillustrated hook to be locked in the closed state.

In the printer 1 of this embodiment, a detachment mechanism 80 is disposed between the outer and inner covers 24A, 24B to set and cancel a link relationship between the outer and inner covers 24A, 24B. This point is described in detail below.

Figure 11:
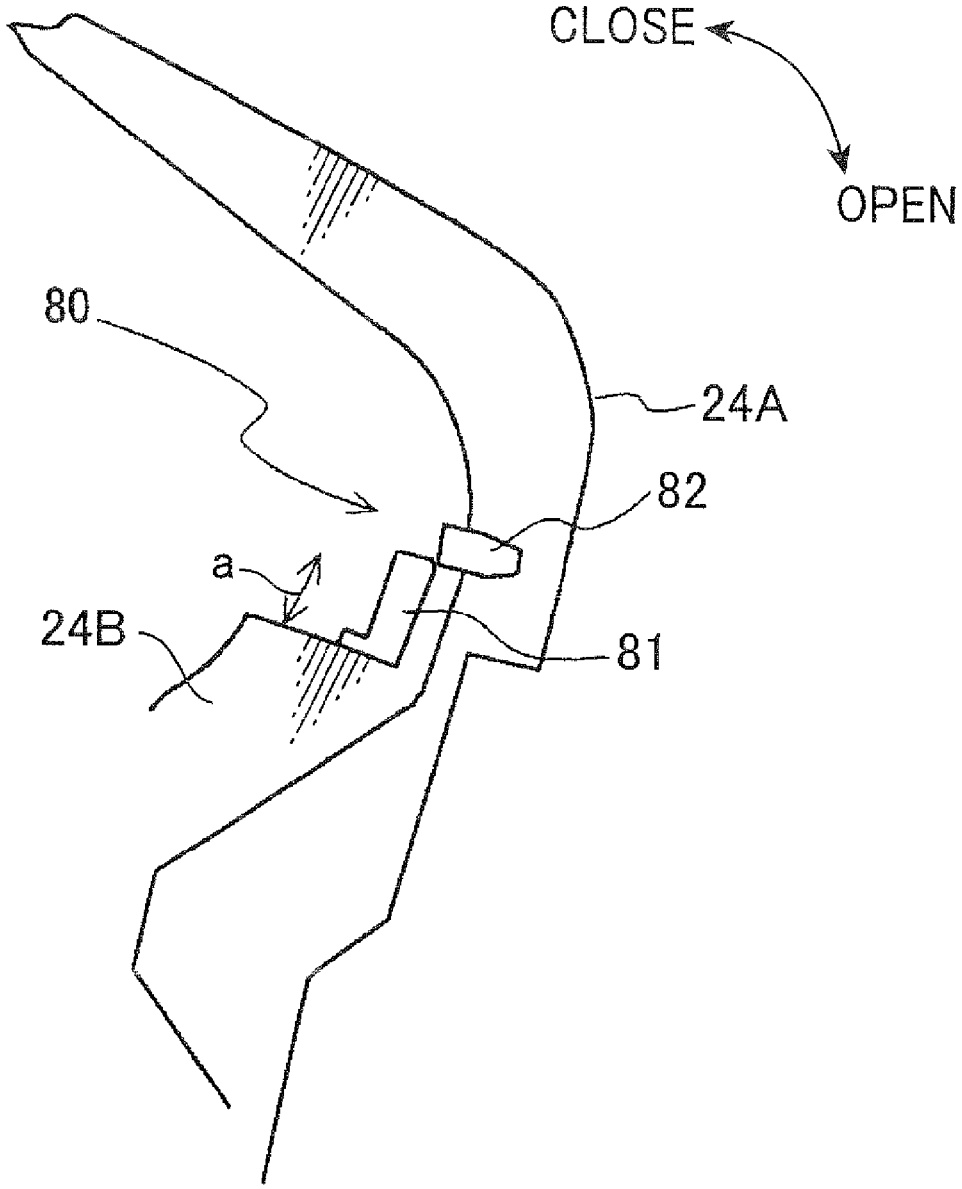
FIG. 11 is a diagram schematically showing an outer cover, the inner cover and a detachment mechanism.

FIG. 11 is a diagram schematically showing the outer cover 24A, the inner cover 24B and the detachment mechanism 80. As shown in FIG. 4, the outer cover 24A is rotated about the first supporting shaft 26, the inner cover 24B is rotated about the second supporting shaft 25, and the upper sides of these covers can pivot substantially in the same directions. The detachment mechanism 80 includes a first hook member 81 and a second hook member 82.

The first hook member 81 is arranged at the upper end of the inner cover 24B. The second hook member 82 is arranged at a position on the inner surface of an upper side of the outer cover 24A corresponding to the first hook member 81. The second hook member 82 moves upward and downward in directions of arrows "a" relative to the first hook member 81 as the outer cover 24A is closed and opened. The arrangement position of the detachment mechanism 80 is near the pair of conveyor rollers 20 in FIG. 2.

Figure 12:
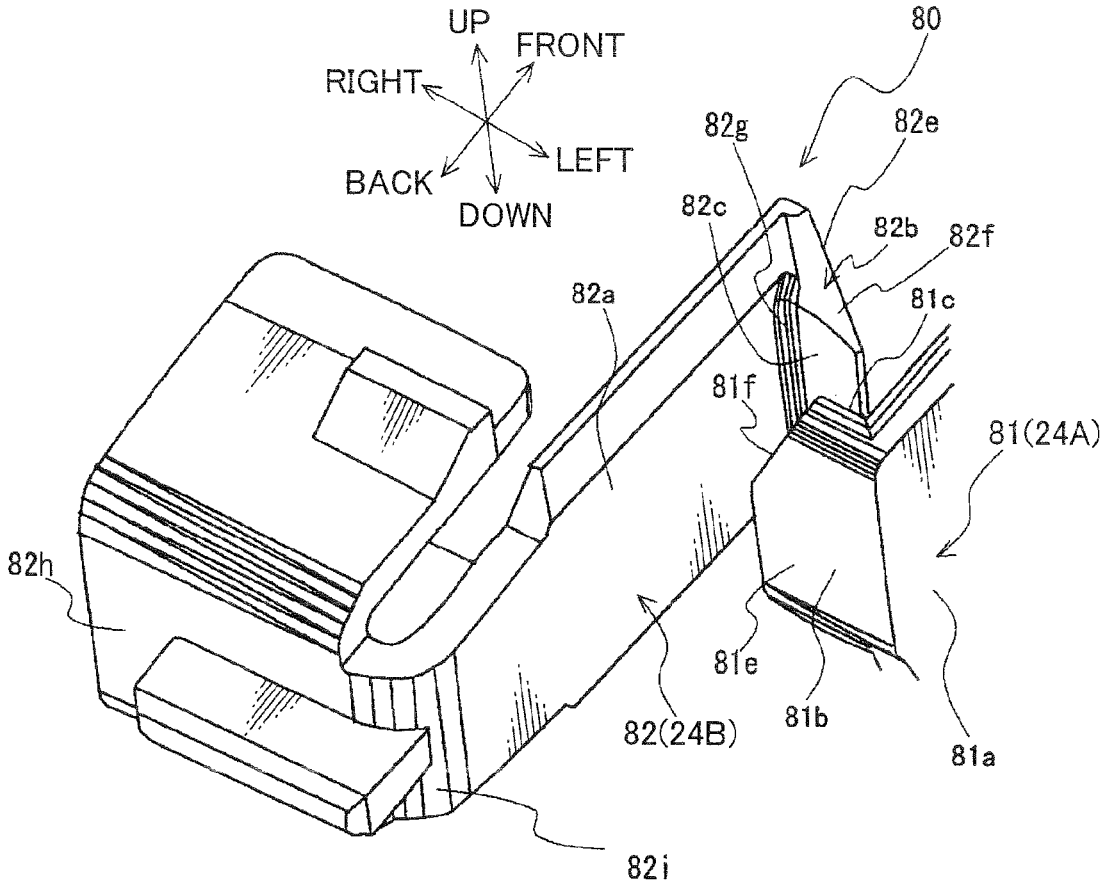
FIG. 12 is a perspective view showing the detachment mechanism in detail.

FIG. 12 is a perspective view showing the detachment mechanism 80 in detail. The first hook member 81 has a base end portion (not shown) thereof fixed to the outer cover 24A. A plate-like first arm 81*a* extends from this base end portion toward the outer cover 24A (backward). A first claw portion 81*b* bent to the right is provided at the leading end (rear end in FIG. 12) of the first arm 81*a*. The first claw portion 81*b* is a plate member substantially parallel to the outer surface of the outer cover 24A, and a first engaging surface 81 is formed on the front side thereof.

This first engaging surface 81*c* is inclined such that a part located at the leading end side (right end side) of the first claw portion 81*b* is located slightly forward than a part located at the base end side (left end side). This is for reliably engaging the first engaging surface 81*c* with a second engaging surface 82*c* of the second hook member 82 to be described later. A rear surface 81*e* of the first claw portion 81*b* extends substantially in the same direction as the first engaging surface 81*c*, but steeper than the first engaging surface 81*c*. The entire first claw portion 81*b* has a thin wedge shape tapered toward the leading end when viewed from above. The first claw portion 81*b* is formed with a cutout 81*f* to be smoothly engaged with and disengaged from the second claw portion 82*b* to be described later. The first claw portion 81*b* is appropriately beveled. The entire first hook member 81 is formed, for example, integral to the frame of the inner cover 24B.

The second hook member 82 has a base end portion 82*h* fixed to the outer cover 24A. A plate-like second arm 82*a* extends from the base end portion 82*h* toward the inner cover 24B (front side) via a curved portion 82*i*. The second claw portion 82*b* bent to the left to reach the first engaging surface 81*c* by way of the leading end of the above first claw portion 81*b* is provided at the leading end (front side in the figures) of the second arm portion 82*a*. The second claw portion 82*b* is a plate member substantially parallel to the outer surface of the outer cover 24A in the closed state, and the second engaging surface 82*c* is formed on the rear surface thereof.

This second engaging surface 82*c* is inclined such that a part located at the leading end side (left end side) of the second claw portion 82*b* is located slightly backward than a part located at the base end side (right end side). In other words, the second engaging surface 82*c* is formed substantially parallel to the first engaging surface 81*c* of the above first claw portion 81*b* and, when the first and second engaging surfaces 81*c*, 82*c* are engaged, a force acts in a direction toward the base end sides of the respective engaging surfaces, i.e. in such a direction as to ensure an engaged state.

A front surface 82*e* of the second claw portion 82*b* is an inclined surface substantially in the same direction as the second engaging surface 82*c* and steeper than the second engaging surface 82*c*, and the entire second claw portion 82*b* has a thin wedge shape tapered toward the leading end when viewed from above. The second claw portion 82*b* is formed with a cutout 82*f* to be smoothly engaged with and disengaged from the first claw portion 81*b*. Recessed grooves 82*g* are formed at the inner side of a connecting portion of the second claw portion 82*b* and the above second arm 82*a* to make the second claw portion 82*b* easily deformable. The second claw portion 82*b* is appropriately beveled. The entire second hook member 82 is, for example, made of synthetic resin, and the second claw portion 82 side is laterally movable mainly with the curved portion 82*i* as a fixed point due to its elasticity.

With the first and second hook members 81, 82 respectively fixed to the inner and outer covers 24B, 24A, the first and second claw portions 81*b*, 82*b* can be relatively moved substantially in the vertical direction. If the outer cover 24A is moved backward with the first claw portion 81*b* located before the second claw portion 82*b*, the leading end of the first claw portion 81*b* collides with the leading end of the second claw portion 82*b*. However, as described above, the second hook member 82 is elastic and deformed in a direction away from the first hook member 81 upon the collision of the first and second claw portions 81*b*, 82*b*. Therefore, the first claw portion 81*b* can move over the leading end of the second claw portion 82*b* to reach the engaging surface 82*c* of the second claw portion 82*b*.

Figure 13A:
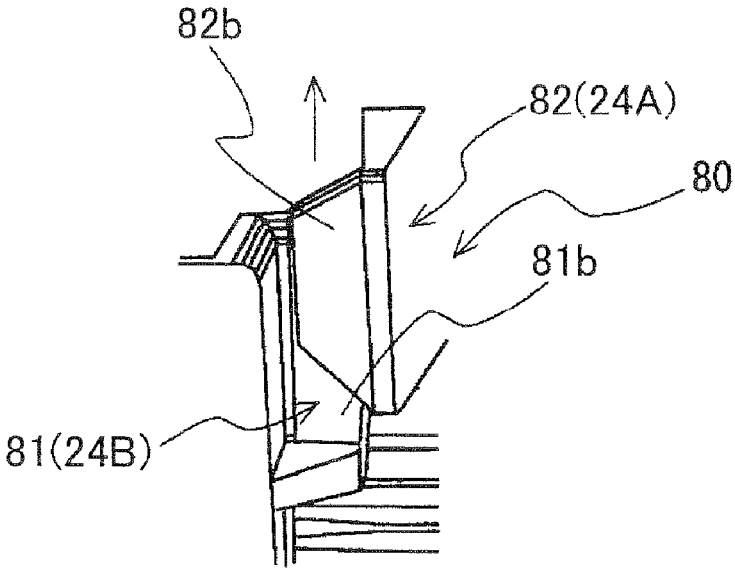
FIGS. 13A, 13B and 14A to 14F are diagrams showing the operation of the detachment mechanism.
Figure 13B:
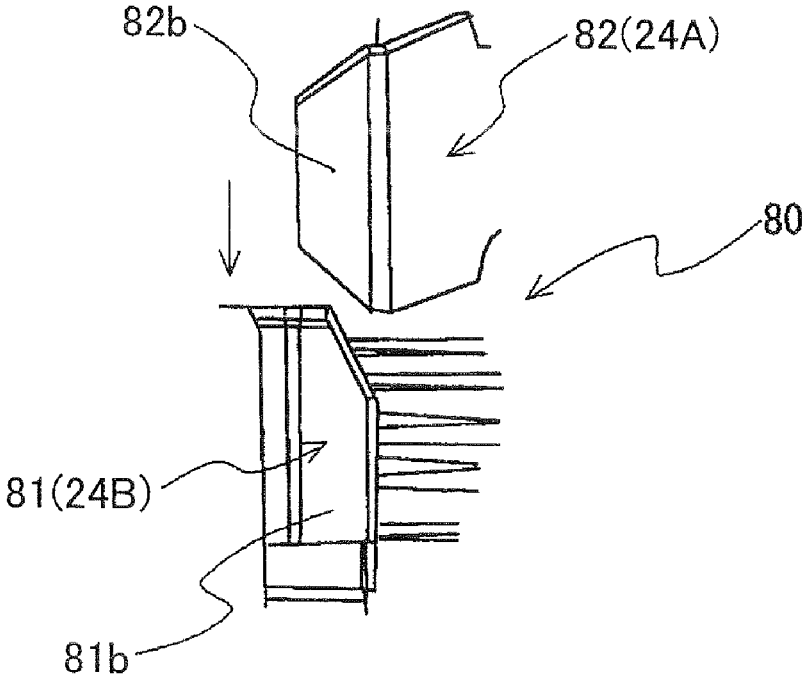
Figures 14A, 14B, 14C, 14D, 14E, 14F:
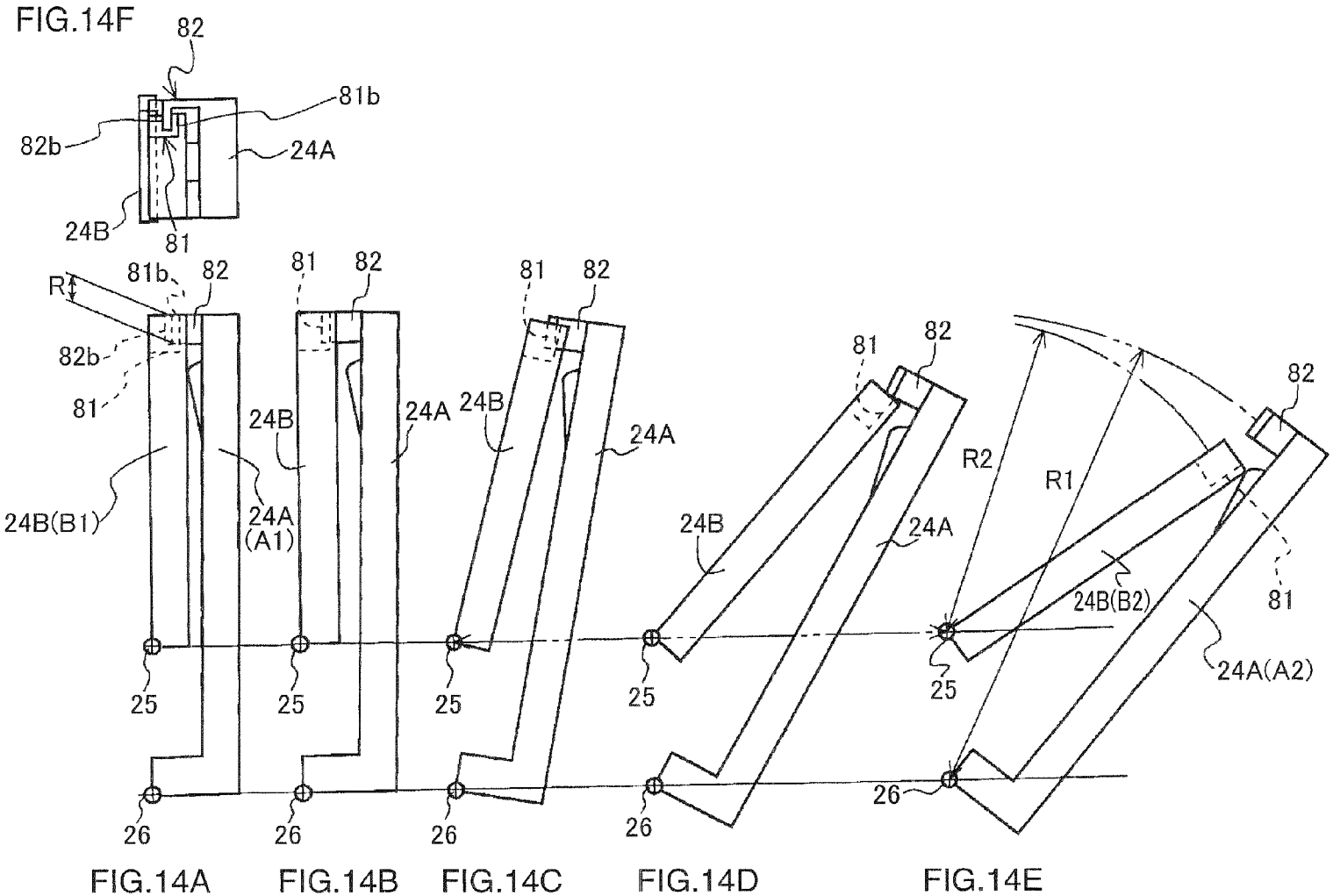

With reference to FIGS. 13A, 13B and 14A to 14F, the operation of the detachment mechanism 80 is described. As shown in FIG. 14A, a vertical engagement length of the first and second claw portions 81*b*, 82*b* is called an effective engagement length R. This effective engagement length R is an engagement length which effectively acts when the second claw portion 82*b* is pulled by the first claw portion 81*b*. In FIG. 14E, R1 denotes a distance from the first supporting shaft 26 of the outer cover 24A to the second hook member 82 and R2 denotes a distance from the second supporting shaft 25 of the inner cover 24B to the first hook member 81.

As shown in FIGS. 13A and 14A, with the outer cover 24A and the inner cover 24B respectively located at closed positions A1, B1, the first claw portion 81*b* of the first hook member 81 and the second claw portion 82*b* of the second hook member 82 are engaged. At this time, the effective engagement length R is maximized. FIG. 14F is a view showing a state of FIG. 14A from above.

As shown in FIGS. 14B and 14C, as an opening angle (angle of inclination) of the outer cover 24A increases, the first hook member 81 moves downward relative to the second hook member 82, whereby the effective engagement length L of these becomes gradually shorter. This results from the fact that the centers of pivotal movements of the outer and inner covers 24A, 24B, i.e. the positions of the first and second shafts 26, 25 differ and the distances R1, R2 differ.

As the outer cover 24A is more opened, the upper end of the first claw portion 81*b* of the first hook member 81 reaches the bottom end of the second claw portion 82*b* of the second hook member 82 as shown in FIG. 14D. Then, the effective engagement length R becomes 0 and the first and second claw portions 81*b*, 82*b* are disengaged. In other words, the first and second hook members 81, 82 are disengaged before reaching specified opened positions A2, B2.

As the opening angle of the outer cover 24A further increases, the outer and inner covers 24A, 24B respectively reach the opened positions A2, B2 with the first and second hook members 81, 82 disengaged as shown in FIGS. 13B, 14E. In this state, the inner cover 24B can be freely pivoted without being restricted by the outer cover 24A. Accordingly, it can be easily performed to pivot the inner cover 24B to temporarily hold it in the engaging portions 104, for example, upon removing a jammed sheet in the reversing claw portion L'.

If the outer cover 24A is closed from the opened state of FIG. 14E, the outer and inner covers 24A, 24B follow a course opposite to the one at the time of opening. In other words, in a state of FIG. 14D, the engagement of the first and second hook members 81, 82 is started and the effective engagement length R gradually becomes longer as shown in FIGS. 14C, 14B. When the outer cover 24A is arranged at the closed position A1, the inner cover 24B is also arranged at the closed position B1. In other words, it is not necessary to individually open and close the inner cover 24B and the inner cover 24B can be opened and closed as the outer cover 24A is opened and closed. Regardless of at which position the inner cover 24B is located, the first and second hook members 81, 82 can be engaged by closing the outer cover 24A.

As described above, the inner cover 24B can be opened and closed by opening and closing the outer cover 24A by providing the detachment mechanism 80. Further, when the outer cover 24A is located at the opened position A2, the first and second hook members 81, 82 are free from the link relationship, wherefore the inner cover 24B can be individually operated. Thus, the inner cover 24B can be temporarily held in the engaging portions 104 without any problem to contribute to an easier jam processing.

As described above, according to the printer 1 of this embodiment, the apparatus main body 100 is formed with the engaging portions 104 for temporarily holding the inner cover 24B in the apparatus main body 100, wherefore the inner cover 24B needs not have a hook for locking the inner cover 24B and a cost reduction can be promoted by reducing the number of parts. Upon a jam processing, the locked state by the hook of the outer cover 24A can be released only by operating the lever provided on the outer cover 24A, wherefore jam processability can be improved.

When the inner cover 24B is temporarily held, the registration roller 19 held on the inner cover 24B can be simultaneously positioned by the guiding portions 105. Thus, the registration roller 19 can be precisely positioned and a stable image forming operation can be realized.

In this embodiment, the registration roller 19 is positioned by the guiding portions 105 provided in the image forming apparatus main body. Instead, the secondary transfer roller 10 may be positioned by the guiding portions 105.

Although the present invention is applied to the color laser printer 1 in the above embodiment, it is, of course, similarly applicable to a monochromatic image forming apparatus.

The above specified embodiment mainly embraces inventions having the following construction.

An image forming apparatus according to one aspect of the present invention comprises an apparatus main body; a cover member openably and closably mounted on the apparatus main body and including an outer cover and an inner cover which are independently opened and closed, the inner cover being positioned by being pushed by the outer cover when the cover member is closed; and an engaging portion provided in the apparatus main body for temporarily holding the inner cover in the apparatus main body.

According to this construction, since the engaging portion for temporarily holding the inner cover in the apparatus main body is formed in the apparatus main body, the inner cover needs not include a hook or the like for locking the inner cover. Therefore, a cost reduction can be promoted by reducing the number of parts.

In the above construction, it is preferable that a first shaft member arranged at a lower position of one side surface of the apparatus main body and a second shaft member arranged at a position of the one side surface of the apparatus main body above the first shaft member are further provided; that the outer cover is supported rotatably about the first shaft member; and that the inner cover is supported rotatably about the second shaft member. According to this construction, a structure for closing the inner cover by pushing it by the outer cover when the cover member is closed and for independently opening and closing the outer and inner covers can be easily built.

In the above construction, it is preferable that an image transfer portion for transferring an image to a sheet, a first conveyance path for conveying the sheet via the image transfer portion and a second conveyance path for returning the sheet having passed the image transfer portion to a side of the first conveyance path upstream of the image transfer portion are further provided; that a wall surface of the first conveyance path at one side is formed by the inner surface of the inner cover; and that a wall surface of the second conveyance path at one side is formed by the outer surface of the inner cover and a wall surface thereof at the other side is formed by the inner surface of the outer cover. According to this construction, a jammed sheet in the first or second conveyance path can be removed by opening the outer and inner covers. Since the inner cover can be temporarily held at this time, the operability of a jam processing can be improved.

In the above construction, it is preferable that a roller member held on the inner cover and a guiding portion provided in the apparatus main body for positioning the roller member are further provided; and that the guiding portion positions the roller member at a position where the inner cover is temporarily held in the apparatus main body. According to this construction, displacements of the roller member can be suppressed since the roller member held on the inner cover can be positioned by the guiding portion when the inner cover is temporarily held.

In the above construction, it is preferable that a guiding portion provided in the apparatus main body for positioning a roller member, a transfer roller held on the inner cover for forming a transfer nip portion in the image transfer portion and a registration roller held on the inner cover to be arranged upstream of the image transfer portion in the first conveyance path are further provided; and that the guiding portion positions the transfer roller or the registration roller at a position where the inner cover is temporarily held in the apparatus main body. According to this construction, the transfer roller or the registration roller held on the inner cover can be simultaneously positioned by the guiding portion when the inner cover is temporarily held, whereby a stable image forming operation can be realized.

In the above construction, it is preferable that a facing roller member provided in the apparatus main body to face the roller member with the inner cover closed is further provided; and that a force of the facing roller member pushing the roller member is utilized as a force for temporarily holding the inner cover. According to this construction, the force of the facing roller member pushing the roller member can be effectively utilized to temporarily hold the inner cover.

In this case, it is preferable that the roller member includes a bearing member at an end portion thereof; that the engaging portion includes a receiving surface portion, into which the bearing member is fitted; and that the receiving surface portion is inclined at a specified angle to a line connecting a shaft center of the roller member and that of the facing roller member. According to this construction, an effect of fixing the bearing member by the inclination of the receiving surface portion can be exhibited.

In the above construction, it is preferable that a transfer facing roller provided in the apparatus main body to form the transfer nip portion together with the transfer roller with the inner cover closed is further provided; and that a force of the transfer facing roller pushing the transfer roller is utilized as a force for temporarily holding the inner cover. According to this construction, the inner cover can be temporarily held, utilizing the force of the transfer facing roller pushing the transfer roller.

In this case, it is preferable that the transfer roller includes a bearing member at an end portion thereof; that the engaging portion includes a receiving surface portion, into which the bearing member is fitted; and that the receiving surface portion is inclined at a specified angle to a line connecting a shaft center of the transfer roller and that of the facing transfer roller. According to this construction, an effect of fixing the bearing member by the inclination of the receiving surface portion can be exhibited.

In the above construction, it is preferable to further comprise a detachment mechanism for opening the inner cover as the outer cover is opened. In this case, it is preferable that the detachment mechanism includes a first hook member arranged on the inner cover and a second hook member arranged on the outer cover and engageable with and disengageable from the first hook member; that the first and second hook members are engaged with each other and the inner cover can be opened as the outer cover is opened with the outer cover closed relative to the apparatus main body; that the first and second hook members are disengaged before the outer cover is rotated by a specified amount about the first shaft member to reach an opened position; and that the outer and inner covers are individually rotatable about the first and second shaft members when the outer cover reaches the opened position.

According to this construction, by disposing the detachment mechanism, the inner cover can be opened and closed as the outer cover is opened and closed. Further, when the outer cover is located at the opened position, the first and second hook members are released from a link relationship, wherefore the outer and inner covers can be individually operated. Therefore, the inner cover can be temporarily held in the engaging portion without any problem, which contributes to an easier jam processing.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

This application is based on Japanese Patent Application No. 2007-313029 filed on Dec. 4, 2007, the contents of which are hereby incorporated by reference.

What is claimed is:

1. An image forming apparatus, comprising:

an apparatus main body;

a cover member openably and closably mounted on the apparatus main body and including an outer cover and an inner cover which are independently opened and closed, the inner cover being positioned by being pushed by the outer cover when the cover member is closed; and an engaging portion provided in the apparatus main body for temporarily holding the inner cover in the apparatus main body;

a roller member held on the inner cover; and a guiding portion provided in the apparatus main body for positioning the roller member, wherein the guiding portion positions the roller member at a position where the inner cover is temporarily held in the apparatus main body.

2. An image forming apparatus according to claim 1, further comprising:

a first shaft member arranged at a lower position of one side surface of the apparatus main body, and a second shaft member arranged at a position of the one side surface of the apparatus main body above the first shaft member;

wherein:

the outer cover is supported rotatably about the first shaft member; and the inner cover is supported rotatably about the second shaft member.

3. An image forming apparatus according to claim 2, further comprising:

an image transfer portion for transferring an image to a sheet, a first conveyance path for conveying the sheet via the image transfer portion, and a second conveyance path for returning the sheet having passed the image transfer portion to a side of the first conveyance path upstream of the image transfer portion;

wherein:

a wall surface of the first conveyance path at one side is formed by the inner surface of the inner cover; and a wall surface of the second conveyance path at one side is formed by the outer surface of the inner cover and a wall surface thereof at the other side is formed by the inner surface of the outer cover.

4. An image forming apparatus according to claim 3, further comprising:

a transfer roller held on the inner cover for forming a transfer nip portion in the image transfer portion, and a registration roller held on the inner cover to be arranged upstream of the image transfer portion in the first conveyance path;

wherein the roller member is defined by at least one of the transfer roller or the registration roller.

5. An image forming apparatus according to claim 1, further comprising a facing roller member provided in the apparatus main body to face the roller member with the inner cover closed, wherein a force of the facing roller member pushing the roller member is utilized as a force for temporarily holding the inner cover.

6. An image forming apparatus according to claim 5, wherein:

the roller member includes a bearing member at an end portion thereof;

the engaging portion includes a receiving surface portion, into which the bearing member is fitted; and the receiving surface portion is inclined at a specified angle to a line connecting a shaft center of the roller member and that of the facing roller member.

7. An image forming apparatus according to claim 4, further comprising a transfer facing roller provided in the apparatus main body to form the transfer nip portion together with the transfer roller with the inner cover closed; wherein a force of the transfer facing roller pushing the transfer roller is utilized as a force for temporarily holding the inner cover.

8. An image forming apparatus according to claim 7, wherein:

the transfer roller includes a bearing member at an end portion thereof;

the engaging portion includes a receiving surface portion, into which the bearing member is fitted; and the receiving surface portion is inclined at a specified angle to a line connecting a shaft center of the transfer roller and that of the facing transfer roller.

9. An image forming apparatus according to claim 1, further comprising a detachment mechanism for opening the inner cover as the outer cover is opened.

10. An image forming apparatus, comprising an apparatus main body;

a cover member openably and closably mounted on the apparatus main body and including an outer cover and an inner cover which are independently opened and closed, the inner cover being positioned by being pushed by the outer cover when the cover member is closed;

an engaging portion provided in the apparatus main body for temporarily holding the inner cover in the apparatus main body;

a first shaft member arranged at a lower position of one side surface of the apparatus main body;

a second shaft member arranged at a position of the one side surface of the apparatus main body above the first shaft member; and a detachment mechanism for opening the inner cover as the outer cover is opened, wherein:

the outer cover is supported rotatably about the first shaft member;

the inner cover is supported rotatably about the second shaft member;

the detachment mechanism includes a first hook member arranged on the inner cover and a second hook member arranged on the outer cover and engageable with and disengageable from the first hook member;

the first and second hook members are engaged with each other and the inner cover can be opened as the outer cover is opened with the outer cover closed relative to the apparatus main body;

the first and second hook members are disengaged before the outer cover is rotated by a specified amount about the first shaft member to reach an opened position; and the outer and inner covers are individually rotatable about the first and second shaft members when the outer cover reaches the opened position.

11. An image forming apparatus, comprising:

an apparatus main body;

a cover member openably and closably mounted on the apparatus main body and including an outer cover and an inner cover which are independently opened and closed, the inner cover being positioned by being pushed by the outer cover when the cover member is closed;

a first shaft member arranged at a lower position of one side surface of the apparatus main body;

a second shaft member arranged at a position of the one side surface of the apparatus main body above the first shaft member; and a detachment mechanism for opening the inner cover as the outer cover is opened, wherein:

the outer cover is supported rotatably about the first shaft member;

the inner cover is supported rotatably about the second shaft member;

the detachment mechanism includes a first hook member arranged on the inner cover and a second hook member arranged on the outer cover and engageable with and disengageable from the first hook member;

the first and second hook members are engaged with each other and the inner cover can be opened as the outer cover is opened with the outer cover closed relative to the apparatus main body;

the first and second hook members are disengaged before the outer cover is rotated by a specified amount about the first shaft member to reach an opened position; and the outer and inner covers are individually rotatable about the first and second shaft members when the outer cover reaches the opened position.

12. An image forming apparatus according to claim 11, further comprising:

a roller member held on the inner cover, and a guiding portion provided in the apparatus main body for positioning the roller member;

wherein the guiding portion positions the roller member at a position where the inner cover is temporarily held in the apparatus main body.

13. An image forming apparatus according to claim 11, further comprising:

an image transfer portion for transferring an image to a sheet;

a first conveyance path for conveying the sheet via the image transfer portion; and a second conveyance path for returning the sheet having passed the image transfer portion to a side of the first conveyance path upstream of the image transfer portion, wherein:

a wall surface of the first conveyance path at one side is formed by the inner surface of the inner cover; and a wall surface of the second conveyance path at one side is formed by the outer surface of the inner cover and a wall surface thereof at the other side is formed by the inner surface of the outer cover.

14. An image forming apparatus according to claim 13, further comprising:

a guiding portion provided in the apparatus main body for positioning a roller member, a transfer roller held on the inner cover for forming a transfer nip portion in the image transfer portion, and a registration roller held on the inner cover to be arranged upstream of the image transfer portion in the first conveyance path;

wherein the guiding portion positions the transfer roller or the registration roller at a position where the inner cover is temporarily held in the apparatus main body.

15. An image forming apparatus according to claim 14, further comprising a transfer facing roller provided in the apparatus main body to form the transfer nip portion together with the transfer roller with the inner cover closed; wherein a force of the transfer facing roller pushing the transfer roller is utilized as a force for temporarily holding the inner cover.

16. An image forming apparatus according to claim 12, further comprising a facing roller member provided in the apparatus main body to face the roller member with the inner cover closed, wherein a force of the facing roller member pushing the roller member is utilized as a force for temporarily holding the inner cover.

17. An image forming apparatus according to claim 16, wherein:

the roller member includes a bearing member at an end portion thereof;

the engaging portion includes a receiving surface portion, into which the bearing member is fitted; and the receiving surface portion is inclined at a specified angle to a line connecting a shaft center of the roller member and that of the facing roller member.

* * * * *